US006854004B2

(12) United States Patent
Spence

(10) Patent No.: US 6,854,004 B2
(45) Date of Patent: Feb. 8, 2005

(54) IRREGULAR OPTICAL INTERCONNECTIONS TO COMPENSATE FOR NON-UNIFORMITIES IN ANALOG OPTICAL PROCESSORS

(75) Inventor: Scott E. Spence, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 609 days.

(21) Appl. No.: 10/028,966

(22) Filed: Dec. 26, 2001

(65) Prior Publication Data

US 2003/0120696 A1 Jun. 26, 2003

(51) Int. Cl.[7] ..... G06E 3/00
(52) U.S. Cl. ..... 708/816
(58) Field of Search ..... 708/816, 191

(56) References Cited

U.S. PATENT DOCUMENTS

| | | | | | |
|---|---|---|---|---|---|
| 4,544,229 | A | | 10/1985 | Verber | 350/96.14 |
| 4,588,255 | A | * | 5/1986 | Tur et al. | 708/816 |
| 4,607,344 | A | * | 8/1986 | Athale et al. | 708/816 |
| 4,613,204 | A | * | 9/1986 | Verber et al. | 708/191 |
| 4,633,428 | A | * | 12/1986 | Byron | 708/835 |
| 4,686,646 | A | * | 8/1987 | Goutzoulis | 708/191 |
| 4,843,587 | A | * | 6/1989 | Schlunt et al. | 708/816 |
| 4,862,406 | A | * | 8/1989 | Fisher | 708/816 |
| 4,963,725 | A | | 10/1990 | Hong et al. | 250/201.9 |
| 4,986,640 | A | * | 1/1991 | Athale | 708/816 |
| 5,063,531 | A | * | 11/1991 | Kawai et al. | 708/816 |
| 5,068,801 | A | * | 11/1991 | Clark et al. | 708/816 |
| 5,134,686 | A | | 7/1992 | Jutamulia et al. | 395/25 |
| 5,434,426 | A | | 7/1995 | Furuyama et al. | 250/551 |
| 5,497,253 | A | | 3/1996 | Stoll et al. | 359/29 |
| 5,539,543 | A | | 7/1996 | Liu et al. | 359/15 |
| 5,541,914 | A | | 7/1996 | Krishnamoorthy et al. | 370/56 |
| 6,008,918 | A | | 12/1999 | Kanterakis et al. | 359/117 |
| 6,016,370 | A | | 1/2000 | Hatakeyama et al. | 382/299 |

OTHER PUBLICATIONS

Applied Optics, vol. 30, No. 8, Mar. 10, 1991, "Information Processing".

* cited by examiner

*Primary Examiner*—Tan V. Mai
(74) *Attorney, Agent, or Firm*—James B. Bechtel, Esq.; Scott R. Boalick, Esq.

(57) ABSTRACT

Using irregular optical interconnections to compensate for non-uniformities in analog optical processors, such as matrix-vector (M-V) optical processors, is disclosed. An M-V processor of one embodiments includes two optical devices, such as spatial light modulators (SLM's). One of the devices represents a matrix, and the other device represents a vector. Each device has non-uniformities. The non-uniformities of the devices are at least substantially matched to one another, where the optical interconnections between the devices are irregular. Light traveling through the devices represents the product of the matrix and the vector. An analog-to-digital (A/D) processor, or converter, can be used to subtract any errors in the product even after substantially matching the non-uniformities, by non-digital electrical or photonic processing.

31 Claims, 7 Drawing Sheets

IRREGULAR OPTICAL INTERCONNECTIONS TO COMPENSATE FOR NON-UNIFORMITIES IN ANALOG OPTICAL PROCESSORS

FIELD OF THE INVENTION

This invention relates generally to analog optical processors, such as matrix-vector optical processors, which perform analog computations and then convert the answer to digital, and then compensate for non-uniformities in such processors that result in computation errors.

BACKGROUND OF THE INVENTION

Most processing technology today relies on electricity. For example, in a typical semiconductor processor, electrons move within transistors for the processor to function. Such processors, when appropriately configured, are the current mainstay in digital technology, which represents information as discrete one or zero bits. However, optical processing technology has slowly been advancing. Optical processing technology relies on light with an adjunct of electronics. In optical processors, photons move within optical and electro-optical devices, causing the processor to function. Optical processors are usually analog technology, in which information can be represented on a continuous (i.e., grayscale) basis.

One type of analog optical processor is a matrix-vector (M-V) processor, which computes the product of an input vector and a matrix. Such processors are useful in artificial intelligence (AI) technologies, such as neural networks. M-V multiplication for a vector c, equal to ($c_1$, . . . , $c_i$, . . . , $c_N$), is computed as shown in equation (1) for each $i^{th}$-component of vector c.

$$c_i = \sum_{j=1}^{N} a_{ij} b_j \tag{1}$$

Components $a_{ij}$ and $b_j$ can be represented in analog by two optical devices exhibiting grayscale. The components are analog in optical transmittance that is normalized to the maximum transmittance possible. For example, let $a_{ij}$ and $b_j$ values be 0.5-grayscale for both devices with 1.0-grayscale as the normalized maximum transmittance. Light passing through both devices will have a value of 0.25-grayscale. For the calculation of two numbers, however, each device could be representing a number from 0 to 100. Thus, the output of both devices represents numbers from 0 to 10,000 (i.e., $0^2$ to $100^2$). Because each device is at 0.5-grayscale, each device represents the number 50 (0.5 times 100). The output of both devices is representing the number 2,500 (0.25 times 10,000). Thus, the output has performed a multiplication, because 50 times 50 is 2,500.

Thus, when light passes through both devices representing the $a_{ij}$ and $b_j$ values, the transmittance of the light is the product, or $a_{ij}b_j$. The summation of the $a_{ij}b_j$ values for $c_i$ is accomplished by combining the relevant individual light beams with a cylindrical lens, and imaging the beams on the $i^{th}$-detector of a detector array. N light beams for each of the N components of vector c are imaged in parallel on the detector array. Each detector in the array has an analog response to the light beams, so that each detector has a component of vector c in an analog form. The components are then converted to digital by an analog-to-digital (A/D) converter.

A limitation in using analog optical M-V processors, and other types of analog optical multiplication processors, is that non-uniformities in the optical devices representing the components to be multiplied cause errors in the resulting product. This limits the bit-width of these processors. The non-uniformities make it difficult to accurately represent the values for the components $a_{ij}$ and $b_j$ in grayscale, because the grayscale responses for each component commonly differ from each other. A single A/D converter is used to convert the analog to the digital in the optical M-V processor. The A/D converter is designed by the characteristics of all of the optical devices in the processor. Non-uniformity implies a range of different characteristics. Thus, an A/D converter cannot be well design to accurately make the numerical conversions from grayscale. Since the uniformities, and lack thereof, determine the bit-width of the answers generated by analog optical processors, compensating for non-uniformities is important to achieving a high bit-width, which is necessary to have high-precision optical processors.

The grayscale response for the components $a_{ij}$ and $b_j$ are specifically not entirely accurate. Rather, they represent the quantities $a_{ij}+\Delta a_{ij}$ and $b_j+\Delta b_j$, where $\Delta a_{ij}$ and $\Delta b_j$ are error values resulting from the non-uniformities of the optical devices. An M-V processor therefore computes the $i^{th}$-component in vector c as shown in equation (2).

$$\chi_i = \sum_{j=1}^{N} (a_{ij} + \Delta a_{ij})(b_j + \Delta b_j) = \sum_{j=1}^{N} a_{ij} b_j + a_{ij}\Delta b_j + \Delta a_{ij} b_j + \Delta a_{ij}\Delta b_j \tag{2}$$

The error for a component of the vector c, $\Delta c_i$, is given by equation (3).

$$\chi_i - c_i = \Delta c_i = \sum_{j=1}^{N} a_{ij}\Delta b_j + \Delta a_{ij} b_j + \Delta a_{ij}\Delta b_j = \sum_{j=1}^{N} \Delta c_{ij} \tag{3}$$

As an example, the $j^{th}$-error for $\Delta c_i$, $\Delta c_{ij}$, can be determined by assuming that the two components for $a_{ij}$ and $b_j$ exhibit the following grayscale characteristics. The $a_{ij}$'s off state is 0.02-grayscale and on state is 0.95-grayscale. The $b_j$'s off state is 0.03-grayscale and on state is 1.05-grayscale. Using the numerical numbers from the earlier example, the input for $a_{ij}$ and $b_j$ is from 0 to 1000. If the number 50 is input to both $a_{ij}$ and $b_j$, the $a_{ij}$ component has a grayscale response of 0.485 that represents the number 48.5, and the $b_j$ component has a grayscale response of 0.54 that represents the number 54, assuming linearity and ideal control. Therefore, the $a_{ij}$ grayscale error, $\Delta a_{ij}$, is −1.5, and the $b_j$ grayscale error, $\Delta b_j$, is 4. Using equation (3), $\Delta c_{ij}$=119, which is also (48.5×54)−(50×50)=2619−2500. Thus, the corresponding numerical error is 119.

Therefore, this error must be subtracted in order for the M-V processor to correctly multiply input vectors with matrices. One approach is to subtract $\Delta a_{ij}$ and $\Delta b_j$ within the system. If these error quantities are known, they can be subtracted. Assuming that the two optical devices in the M-V processor representing $a_{ij}$ and $b_j$ are well characterized, the grayscale responses for all the components can be computed, and their responses compensated. For example, if the number for $a_{ij}$ is set to 50, as above, then $a_{ij}$ converts to 48.5 as a result of the $\Delta a_{ij}$ error. This error can be adjusted, assuming linearity and ideal control. If 51.6129 is instead input, the $a_{ij}$ component converts to 50, the desired value. The conversion to obtain 50 is shown in equation (4).

$$\frac{0.50-0.02}{0.95-0.02}\times 100 = 51.6129 \quad (4)$$

In principle, such error compensation could be performed by using digital electrical processing prior to the optical analog processing. However, a large amount of processing is necessary to compensate for all of the components in a modern optical M-V processor to increase the bit-width of the answer. Such an amount of digital electrical processing defeats the performance advantage of the optical processor. Thus, what is needed is a method for improving the bit-width (i.e., the precision) of the optical processor without increasing the overall processing time.

SUMMARY OF THE INVENTION

The invention uses irregular optical interconnections to compensate for device non-uniformity in analog optical processors, such as matrix-vector (M-V) optical processors. An M-V processor of one embodiment includes two optical devices, such as spatial light modulators (SLM's). One of the devices represents a matrix, and the other device represents a vector. Typically, this other device represents a given vector in multiple locations. Each device has non-uniformities. The non-uniformities of the devices are substantially matched to one another, by matching grayscale responses of the device with one another. Due to the randomness of the non-uniformities, the most optimal grouping of matched devices uses optical interconnections between the devices that are irregular. Light traveling through the devices represents the interim calculations for the product of the matrix and the vector. When the light is fanned into the detectors (by an irregular optical interconnection), which is a summation process, the analog part of the processor has computed each of the components for the resultant vector. An analog-to-digital (A/D) processor, or converter, after each detector is used to generate the digital component of the resultant vector with substantial reduction in the errors.

It can be seen that a uniform set of devices can lead to an improvement in the bit-width. For this method, uniform generally means that for any sub-device utilized in the computation of the $i^{th}$ component of vector c, $(c_1, \ldots, c_i, \ldots, c_N)$, the off state and on state characteristics are the same for all of these sub-devices. For example, let all sub-devices representing $a_{ij}$ and $b_j$, $b_j^{(i)}$, have a grayscale off state of $g_{off}$. For any of the light beams arriving at the $i^{th}$ detector of the detector array, the grayscale multiplication is $(g_{off})^2$. Collectively, the N light beams have a gray scale of $N\cdot(g_{off})^2$. Similarly, the highest M-V multiplication has a gray scale of $N\cdot(g_{on})^2$.

The A/D converter is constructed to range between both of these grayscale extremes. For the $i^{th}$ component of vector c, the lowest number, $$N_2\cdot\left(c_i^{high}\right)^2,$$

is assigned to the grayscale of $N\cdot(g_{on})^2$. The value of having identical sub-devices is that an increase of any number $\Delta n$ represented by a sub-device will have the appropriate grayscale increase, $\Delta g$, for that sub-device and this grayscale increase, $\Delta g$, will be the same for all of the sub-devices. However, this grayscale increase, $\Delta g$, will not be the same for all of the sub-devices unless there is uniformity for the 2N sub-devices utilized in the computation for the $i^{th}$ component of vector c. Numerical simulations of the optical processor should be used to determine the processor bit-width as a function of sub-device uniformity.

The invention provides for advantages over the prior art. In the prior art, the non-uniformities in the system imply that there are errors in the representations of the numbers. After the analog optical processing has been performed, an A/D converter generates the numbers from their analog representation format. Because the representations are not the same, an A/D converter cannot convert the analog representation to digital with a high bit-width. The invention can group devices that are more uniform with each other, such that a more well characterized A/D converter can be constructed. Thus, a higher bit width is obtained. The A/D converters operate in parallel so that the same amount of time is required, as in the prior art, for the A/D conversion process. Thus, the invention achieves an increase in the bit-width of matrix-vector computations more advantageously than in the prior art without increasing the overall processing time. Other advantages, aspects, and embodiments, of the invention will become apparent by studying the detailed description that follows and by referencing the accompanying drawings.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, electrical, and other changes may be made without departing from the spirit or scope of the present invention. The following detailed description is, therefore, not to be taken in a limiting sense, and the scope of the present invention is defined only by the appended claims.

Figure 1:
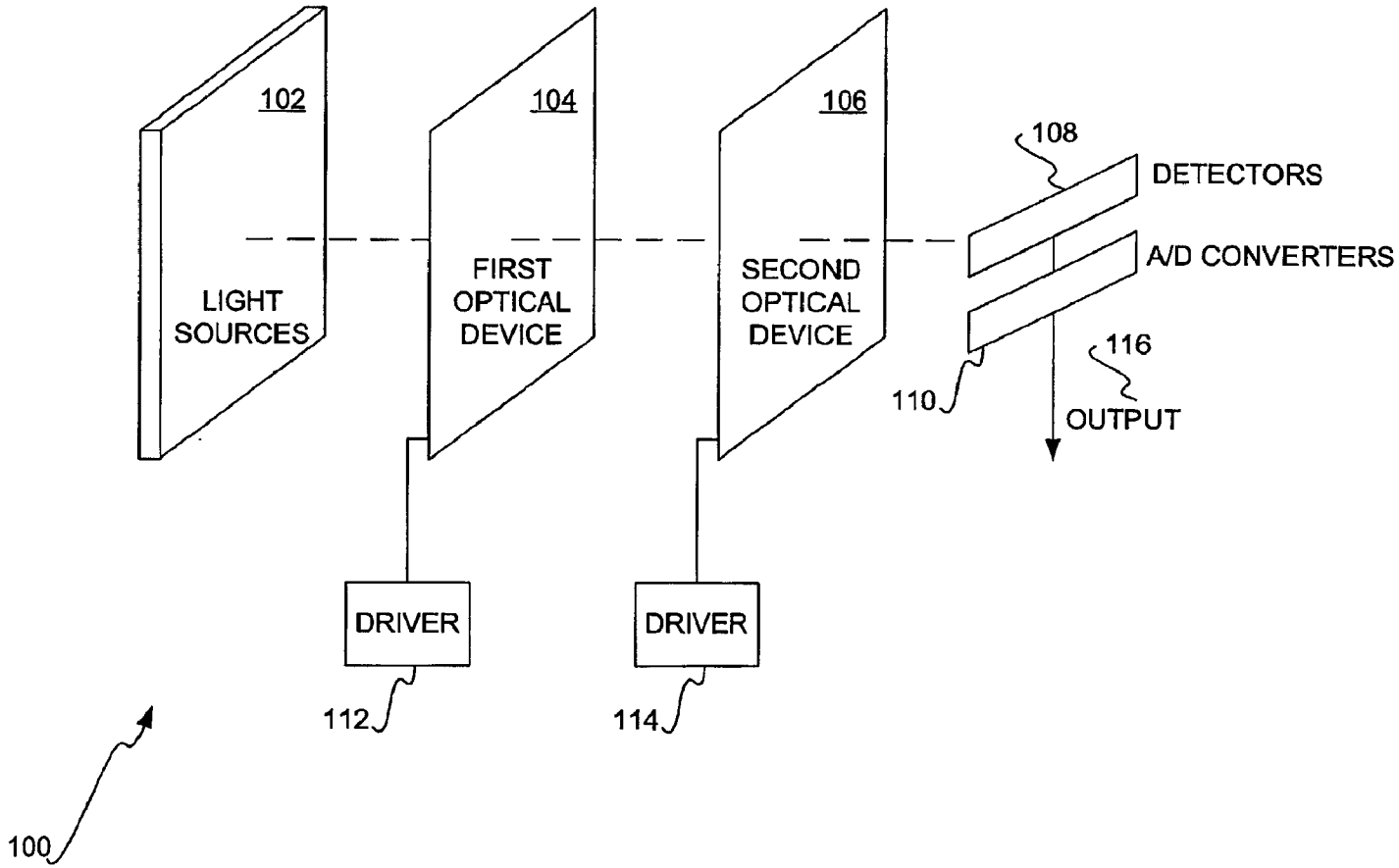
FIG. 1 is a diagram of a matrix-vector (M-V) analog optical processor according to an embodiment of the invention.

FIG. 1 shows an optical analog processor 100 according to an embodiment of the invention, which is more specifically a matrix-vector processor. The processor 100 includes light sources 102, a first optical device 104, a second optical device 106, detectors 108, analog-to-digital (A/D) converters 110, and drivers 112 and 114. The light sources 102 provides beams of light within the processor 100, for traveling through the optical devices 104 and 106, and then for detection by the detectors 108. The light sources 102 may be, for example, vertical-cavity surface-emitting lasers, or another type of light source.

Each of the first and the second optical devices 104 and 106 can be a spatial light modulator (SLM), or another type of optical device. The first optical device 104 specifically represents a vector, and the second optical device 106 represents a matrix. The devices 104 and 106 have coupled thereto electrical drivers 112 and 114, respectively, that power the devices 104 and 106. The devices 104 and 106 have non-uniformities that affect their representation of the vector and the matrix, respectively. To compensate for these non-uniformities, the non-uniformities of the device 104 are matched to the non-uniformities of the device 106, such that the optical interconnections between the devices 104 and 106 are irregular. That is, the grayscale responses of the devices 104 and 106 are matched to one another. This is described in more detail later in the detailed description.

Light traveling through the first device 104 and then through the second device 106 thus represents the matrix-vector product, when summed at the detectors 108, of the vector and the matrix represented by the devices 104 and 106, respectively. The detectors 108 detect such light, and specifically may be an array of detectors. The detectors 108 convert the light detected into electrical energy, which is converted from analog to digital by the A/D converters 110, which may specifically be an array of converters. The A/D converters 110 therefore provide the output 116 of the processor 100, representing the matrix-vector product of the vector and the matrix represented by the devices 104 and 106, respectively. The A/D converters 110 will subtract to a larger degree any errors in the matrix-vector product that remain even after substantially matching of the non-uniformities of the devices 104 and 106, by non-digital electrical processing.

Figure 2:
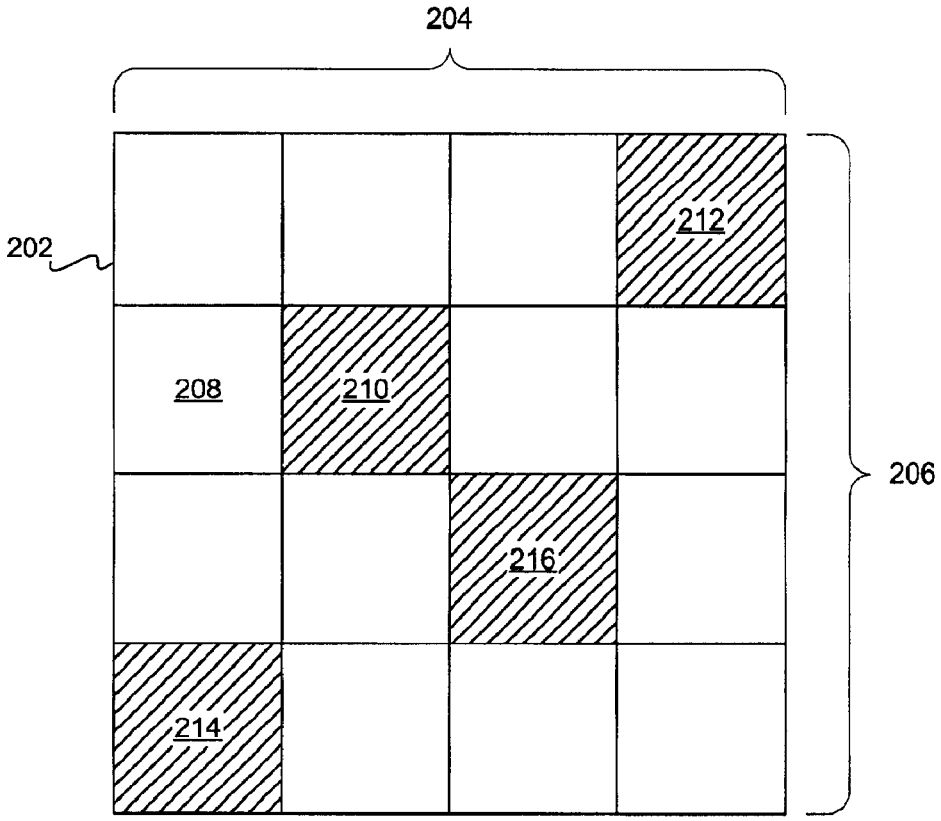
FIG. 2 is a diagram showing an optical device, such as that which may be used to represent the matrix and/or the vector in multiple locations in the processor of FIG. 1, in more detail, according to an embodiment of the invention.

FIG. 2 shows in more detail an optical device 202 that may act as one of the optical devices 104 and 106 of FIG. 1. The optical device 202 is divided into sub-devices organized into columns 204 and rows 206, such as the sub-device 208. The optical device 202 is specifically a 4×4 device, because there are four rows and four columns of sub-devices, although the invention is generally applicable to any M×P device. The grayscale response of each sub-device is different, such that the non-uniformities of each sub-device are different.

The non-uniformities of each sub-device are characterized, and the sub-devices are organized into four groups, with each group including four sub-devices. Each group represents a component of the matrix, $a_{ij}$, or the vector, $b_j$, depending on whether the optical device 202 is representing the matrix or the vector, where the sub-devices of each group represent the grayscale response of a component. Each group is organized to optimize the accuracy of a corresponding component of the matrix-vector product, $c_i$, based on the characteristics of the grayscale response or non-uniformities of the sub-devices within each group. As shown in FIG. 2, shaded sub-devices 210, 212, 214, and 216 represent one such group.

More specifically, the characterizing and matching of the non-uniformities of the sub-devices within each group allows for efficient subtraction of the errors $\Delta a_{ij}$ and $\Delta b_j$ within the processor 100. Because the values $\Delta a_{ij}$ and $\Delta b_j$ are known and grouped by similarity for each $i^{th}$-component in vector c, they can subsequently be efficiently subtracted at the A/D converters 110 (not shown in FIG. 2) for each $i^{th}$-detector by non-digital electrical or photonic processing. Because processing is performed in parallel at the detectors 108 (also not shown in FIG. 2), the maintains the same amount of processing time as the prior art needs, but increases the bit-width of the computed answer.

Figure 3:
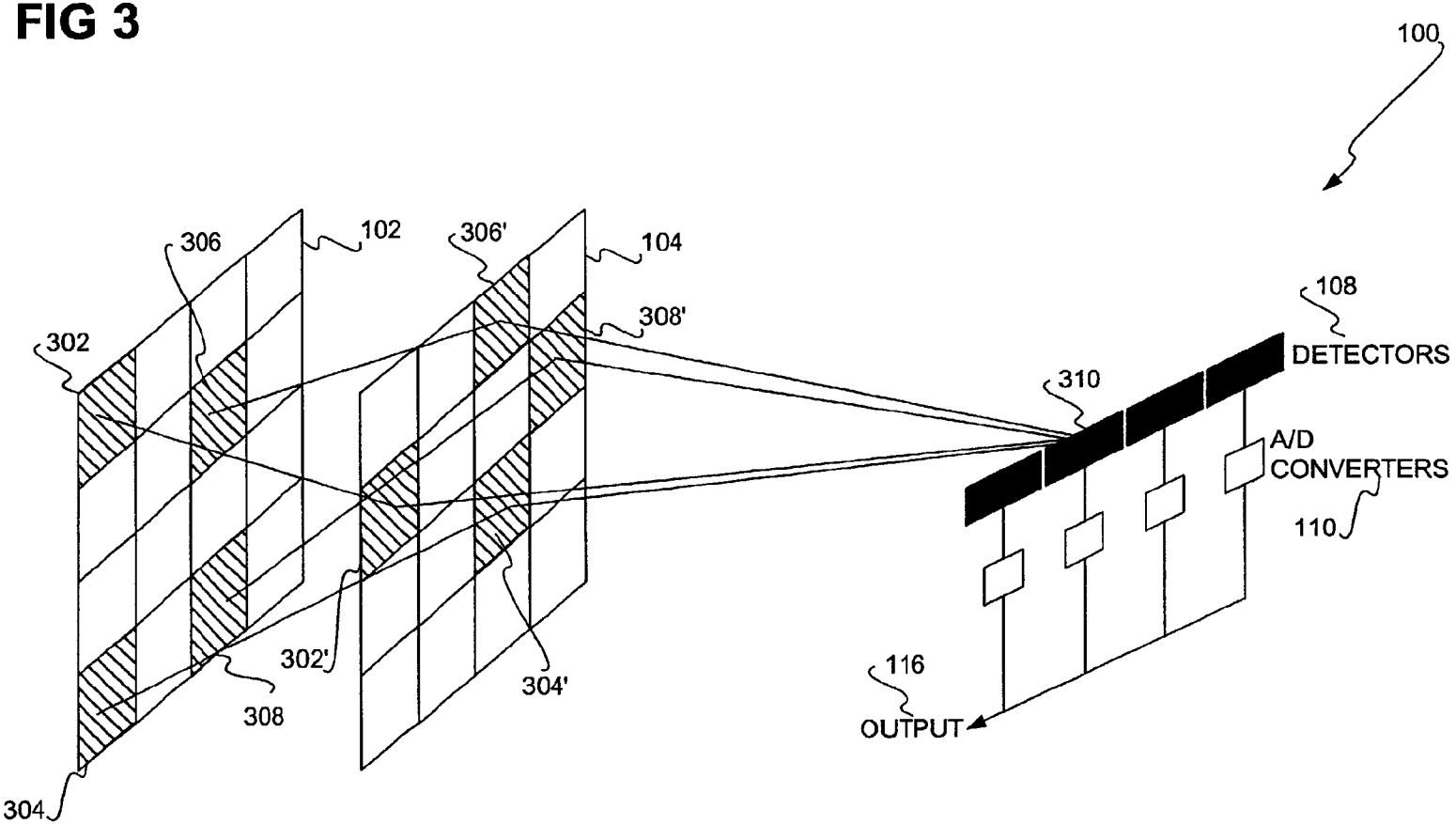
FIG. 3 is a diagram showing more specifically how the processor of FIG. 1 achieves irregular optical interconnections to compensate for non-uniformities within the optical devices of the processor, according to an embodiment of the invention.

FIG. 3 shows how the sub-devices of the optical devices 102 and 104 of the processor 100 are optically interconnected in an irregular manner to achieve increased bit-width of the resulting matrix-vector product. The optical device 102 representing the input vector has sub-devices 302, 304, 306, and 308 grouped together to represent the input vector, $(b_1, b_2, \ldots, b_N)$. Similarly, the optical device 104 representing the matrix has sub-devices 302', 304', 306', and 308' grouped together to represent one component of the matrix, $a_{ij}$. The non-uniformities, or grayscale response, of the sub-devices 302, 304, 306, and 308 of the device 102 are specifically matched to those of the sub-devices 302', 304', 306', and 308' of the device 104 to minimize errors in the resulting matrix-vector product computation.

The light beams traveling through the sub-device 302, 304, 306, and 308, and then through the sub-devices 302', 304', 306', and 308' are along irregular optical interconnections between the devices 102 and 104. An irregular optical interconnection generally is one in which light is specifically directed from one particular position to another particular position, such that the interconnections lack symmetry. By comparison, a regular optical interconnection is generally one in which the light beams display symmetry. For example, the light paths may be parallel to one another, or they may be diffracted from a single point source such that they fan out in a regular manner. Due to the randomness of the non-uniformities of the devices, optimal interconnections will with high probability need irregular interconnections.

The irregular optical interconnections between the devices 102 and 104 in FIG. 3 thus are such that one light beam travels on a path from the sub-device 302 to the sub-device 302', which is not a regular path as compared to the light beam traveling on a path from the sub-device 304 to the sub-device 304', and so on. After traveling through the optical devices 102 and 104, the sum of the individual beams of light represent the $i^{th}$-component of the matrix-vector product, $c_i$, and are interconnected on the detector 310, where the detector 108 is actually an array of detectors including the detector 310. Such interconnection is also accomplished by an irregular interconnection scheme described later, or by another manner.

The detectors 108 converts the detected light to electrical energy, which is then passed along to the A/D converters 110 to convert the energy from analog to digital, such that the output 116 represents the matrix-vector product of the vector represented by the device 102 and the matrix represented by the device 104. As has been indicated, the converters 110 will subtract to a larger degree any errors that remain in the matrix-vector product after the non-uniformities of the device 102 have been matched to the non-uniformities of the device 104.

Figure 4:
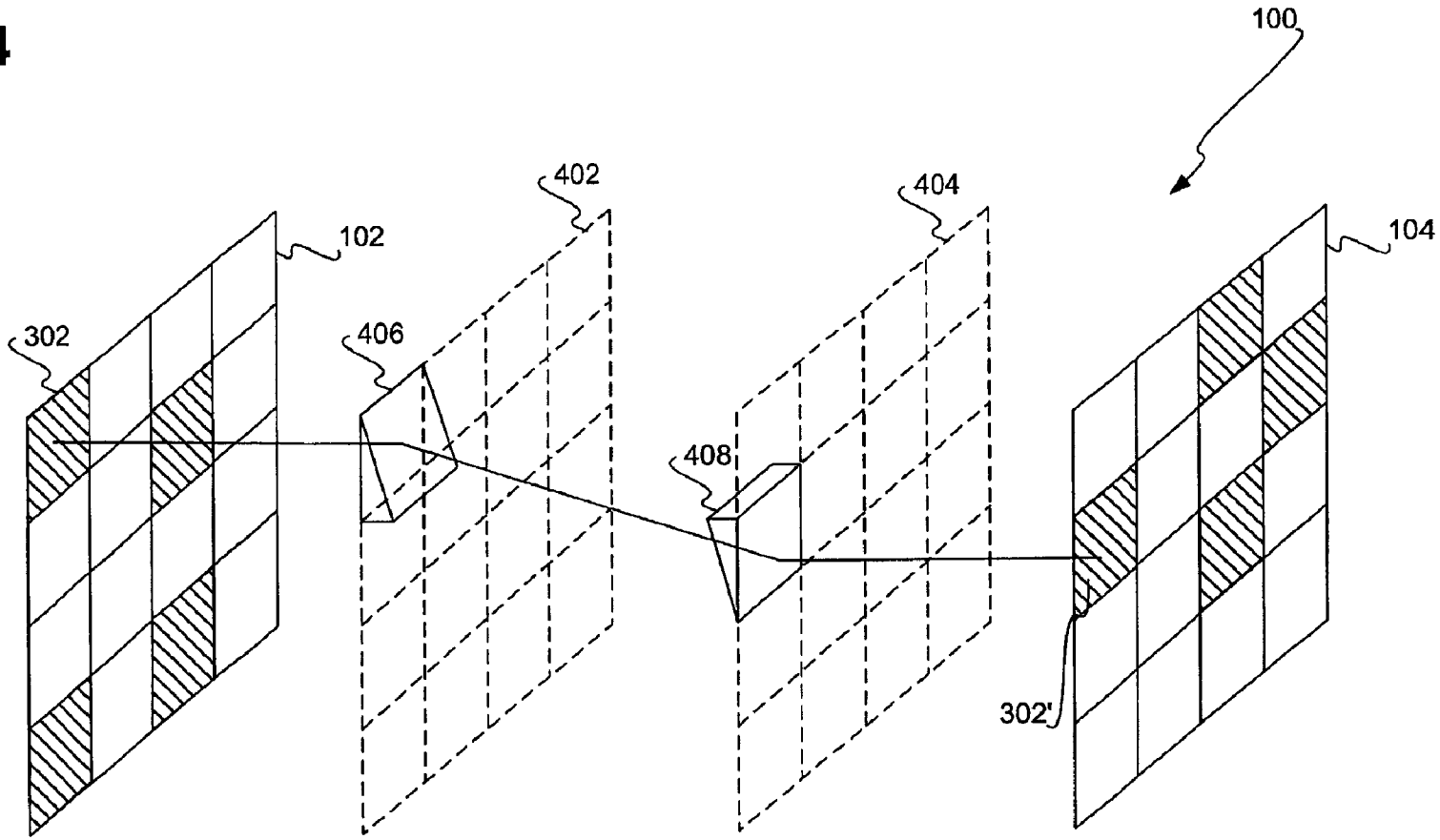
FIG. 4 is a diagram showing how one embodiment of the invention achieves the irregular optical interconnections of FIG. 3 using prisms.

FIG. 4 shows how the irregular optical interconnections between the optical devices 102 and 104 can be achieved by using prisms. Between the devices 102 and 104 of the processor 100 are prism arrays 402 and 404, including prisms such as the prisms 406 and 408, respectively. The irregular optical connection between sub-device 302 of the device 102 and the sub-device 302' of the device 104 is specifically shown. The prism 406 redirects the light beam emanating through the sub-device 302 to the prism 408. Similarly, the prism 408 redirects the light beam emanating through the prism 406 to the sub-device 302'. Other devices other than prisms, can also be used.

Figure 5:
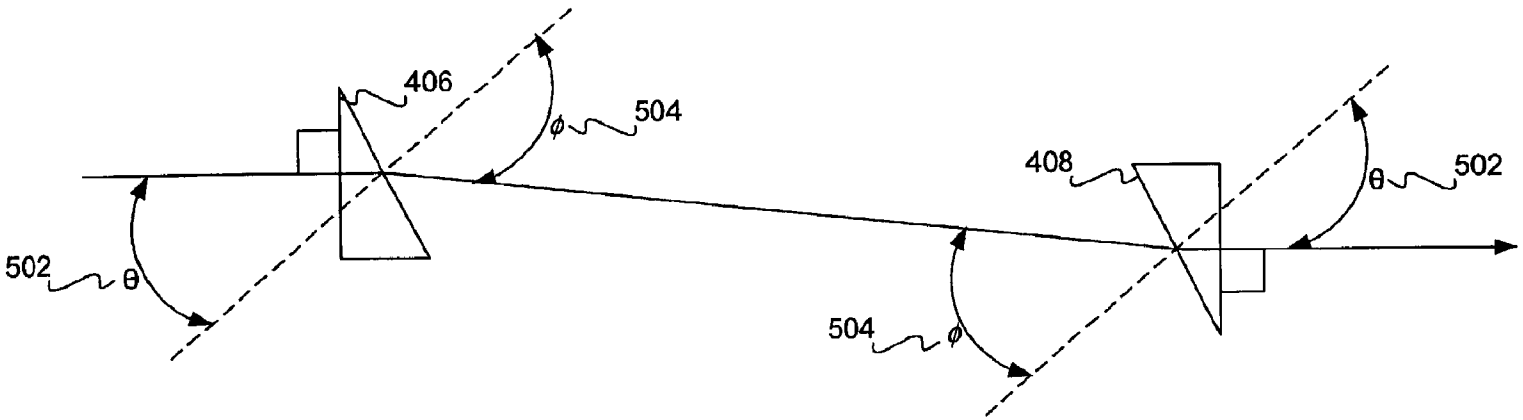
FIGS. 5, 6, and 7 are diagrams showing the optics of using prisms to achieve irregular optical interconnections as in FIG. 4.
Figure 6:
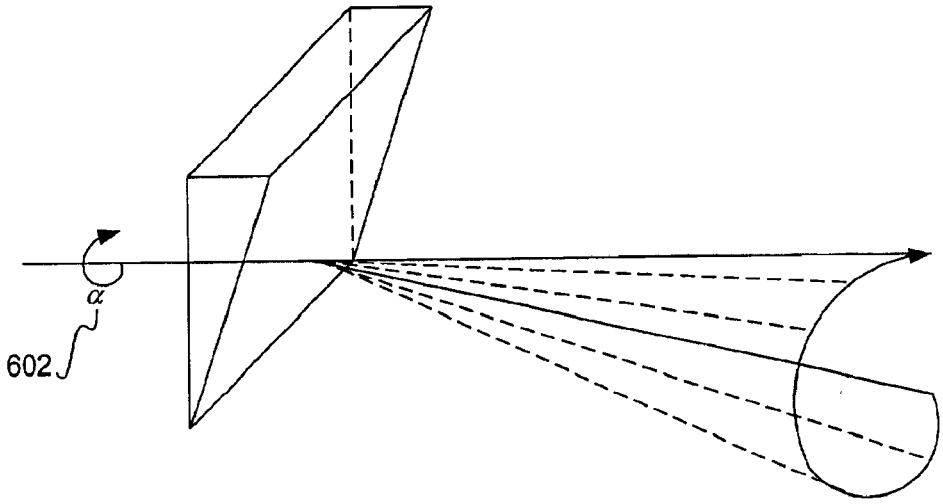
Figure 7:
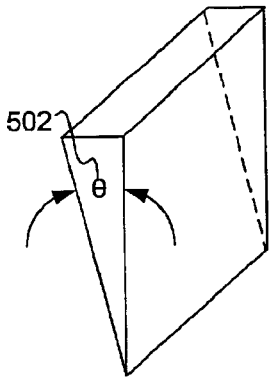

FIGS. 5, 6, and 7 show the optics of the prisms 406 and 408 of FIG. 4. The prisms 406 and 408 are identically constructed, but oriented differently in their respective prism arrays 402 and 404 (not shown in FIGS. 5, 6, and 7). By rotating the prism through an angle $\alpha$, as indicated by the reference number 602 in FIG. 6, the exiting light from a prism sweeps out a cone shape, if the input light beam is normal as is shown for the prism 406 in FIG. 5. The prism wedge angle $\theta$, indicated by the reference number 502 in FIGS. 5 and 7, determines the deflection of light angle $\phi$, indicated by the reference number 504 in FIG. 5, from the exiting normal face of the prism. The angle $\phi$ determines the cone angle.

Thus, the prism 406 at any position in the prism array 402 can potentially be made to direct the light beam to a position anywhere in the prism array 404. The prism 408 in the prism array 404 at the position of interest can change the direction of the light beam so that it exits the prism 408 normal to its exiting face, if the prism 408 is so appropriately oriented. The exit light beam of the prism 408 is thus parallel to the input light beam of the prism 406, and is appropriately translated to achieve the irregular optical connection.

Figure 8:
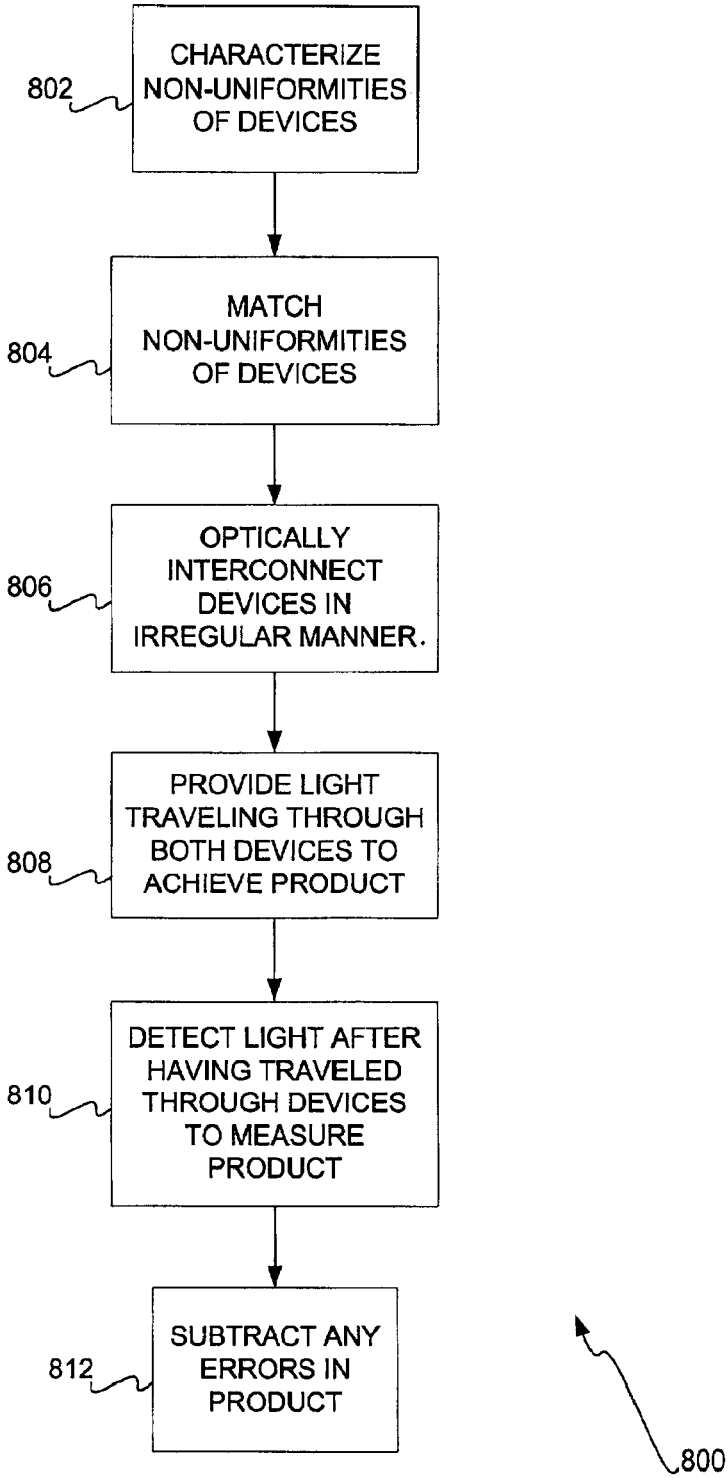
FIG. 8 is a flowchart of a method according to an embodiment of the invention.

FIG. 8 outlines a method 800 for compensating for non-uniformities within the optical devices of an analog optical processor, such as a matrix-vector processor, using irregular optical connections. The non-uniformities of the optical devices are first characterized, such as by characterizing the grayscale responses of the devices (802). The non-uniformities are at least substantially matched so that the error in the product that will result between the mathematical constructs represented by the optical devices is minimized, such as by matching the grayscale responses of the devices (804). The term mathematical constructs is a general term meant to encompass input vectors, matrices, and so on. Based on the matching of the non-uniformities of the devices, the devices are optically interconnected with each other in an irregular manner (806). This may include using prisms, as has been described.

Beams of light are then provided that travel through both devices along the irregular optical interconnections to achieve the product of the mathematical constructs represented by the two optical devices (808). In the case of a matrix-vector processor where one optical device represents an input vector and the other optical device represents a matrix, this product is specifically a matrix-vector product. The multiple light beams representing the product, after having traveled through both of their respective devices, are appropriately summed and detected to measure the product as electrical energy (810), such as by a detector array. Any errors that remain in the product, even after matching the non-uniformities has occurred, can be subtracted by non-digital electrical processing of an A/D converter (812), which also converts the resulting product from analog to digital. The output of the A/D converter thus represents the product of the mathematical constructs represented by the two optical devices.

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. For example, where the invention has largely been described in the context of an analog optical processor that is a matrix-vector processor, the invention is applicable to other types of analog optical processors as well. Therefore, it is manifestly intended that this invention be limited only by the claims and equivalents thereof.

I claim:

1. A matrix-vector analog optical processor device comprising:

a first optical device representing a matrix and having non-uniformities; and, a second optical device representing a vector and having non-uniformities at least substantially matched to the non-uniformities of the first optical device, such that optical interconnections between the first optical device and the second optical device are irregular, wherein light traveling through the first optical device and the second optical device represents a matrix-vector product of the matrix represented by the first optical and the vector represented by the second optical device.

2. The device of claim 1, further comprising an analog-to-digital processor to minimize errors in the matrix-vector product after substantially matching the non-uniformities of the second optical device to the non-uniformities of the first optical device.

3. The device of claim 2, wherein the analog-to-digital processor minimizes errors in the matrix-vector product that remain by one of electrical and photonic processing.

4. The device of claim 1, further comprising a detector array to detect the light traveling through the first optical device and the second optical device representing the matrix-vector product.

5. The device of claim 4, further comprising one or more prisms to achieve the irregular optical interconnections between the second optical device and the detector array.

6. The device of claim 1, further comprising one or more prisms to achieve the irregular optical interconnections between the first optical device and the second optical device.

7. The device of claim 1, further comprising one or more prisms to achieve the irregular optical interconnections between any two devices.

8. The device of claim 1, further comprising an electrical driver for each of the first and the second optical devices.

9. The device of claim 1, further comprising a light source to provide the light traveling through the first optical device and the second optical device.

10. The device of claim 1, wherein at least one of the first and the second optical devices is a spatial light modulator (SLM).

11. The device of claim 1, wherein the first optical device comprises a plurality of sub-devices organized into a plurality of groups, each group representing a vector, the sub-devices of the group representing a grayscale response of the component of the vector.

12. The device of claim 1, wherein the second optical device comprises a plurality of sub-devices organized into a plurality of groups, each group representing a row of the matrix, the sub-devices of the group representing a grayscale response of the component of the row of the matrix.

13. A method comprising:

substantially matching non-uniformities of a first optical device representing a vector with non-uniformities of a second optical device representing a matrix;

optically interconnecting the first optical device with the second optical device in an irregular manner consistent with the substantially matching of the non-uniformities of the first optical device with the non-uniformities of the second optical device; and, providing light traveling through the first optical device and the second optical device along the irregular manner to yield a matrix-vector product of the vector represented by the first optical device and the matrix represent by the second optical device.

14. The method of claim 13, further initially comprising characterizing the non-uniformities of the first optical device and the non-uniformities of the second optical device.

15. The method of claim 14, further comprising increasing the matching of the non-uniformities of the first optical device and the non-uniformities of the second optical device by using optical devices with a greater number of sub-devices in at least one of the optical devices than is necessary for the matrix-vector processor.

16. The method of claim 13, further comprising minimizing errors in the matrix-vector product after substantially matching the non-uniformities of the first optical device with the non-uniformities of the second optical device.

17. The method of claim 16, wherein subtracting any errors in the matrix-vector product comprises using an analog-to-digital processor.

18. The method of claim 16, wherein subtracting any errors in the matrix-vector product comprises electrically processing the matrix-vector product.

19. The method of claim 13, further comprising detecting the light after traveling through the first optical device and the second optical device to measure the matrix-vector product.

20. The method of claim 13, wherein optically interconnecting the first optical device with the second optical device in the irregular manner comprises using one or more prisms.

21. The method of claim 13, wherein at least one of the first and the second optical devices is a spatial light modulator (SLM).

22. The method of claim 13, wherein the first optical device comprises a plurality of sub-devices organized into a plurality of groups, each group representing a vector, the sub-devices of the group representing a grayscale response of the component of the vector.

23. The method of claim 13, wherein the second optical device comprises a plurality of sub-devices organized into a plurality of groups, each group representing a row of the matrix, the sub-devices of the group representing a grayscale response of the row of the matrix.

24. An analog optical processor device comprising:

a first non-uniform optical device representing a first mathematical construct and having a plurality of sub-devices organized into a plurality of groups, each group representing a component of the first construct, the sub-devices of the group representing a grayscale response of the component of the first construct; and, a second non-uniform optical device representing a second mathematical construct, at least substantially matched to the first non-uniform optical device such that optical interconnects between the first and the second optical devices are irregular, and having a plurality of sub-devices organized into a plurality of groups, each group representing a component of the second construct, the sub-devices of the group representing a grayscale response of the component of the second construct, wherein light traveling through the first and the second optical devices represents a product of the first and the second mathematical constructs.

25. The device of claim 24, further comprising an analog-to-digital processor to subtract any errors in the product that remain even after substantially matching of the first and the second optical devices.

26. The device of claim 24, further comprising a detector array to detect the light traveling through the first and the second optical devices representing the product.

27. The device of claim 26, further comprising one or more prisms to achieve the irregular optical interconnections between the second optical device and the detector array.

28. The device of claim 24, further comprising one or more prisms to achieve the optical interconnections between the first and the second optical devices that are irregular.

29. The device of claim 24, further comprising one or more prisms to achieve the irregular optical interconnections between the first optical device and the second optical device.

30. The device of claim 24, wherein at least one of the first and the second optical devices is a spatial light modulator (SLM).

31. The device of claim 24, wherein the first mathematical construct is a vector and the second mathematical construct is a matrix, such that the product is a matrix-vector product.

* * * * *